US006055821A

United States Patent [19]

Song et al.

[11] Patent Number: 6,055,821

[45] Date of Patent: May 2, 2000

[54] PURGE SYSTEM FOR AN ABSORPTION AIR CONDITIONER

[75] Inventors: Deog Yong Song, Seoul; In Shik Moon, Uijung Bu; Kap Duck Kim, Kwang Myoung, all of Rep. of Korea

[73] Assignee: Carrier Corporation, Farmington, Conn.

[21] Appl. No.: 09/168,762

[22] Filed: Oct. 8, 1998

[51] Int. Cl.[7] ..... F25B 43/04

[52] U.S. Cl. ..... 62/195; 62/475

[58] Field of Search ..... 62/195, 483, 488, 62/475, 112

[56] References Cited

U.S. PATENT DOCUMENTS 3,299,666 1/1967 Hopkins et al. .

3,301,005 1/1967 Eisberg .

3,949,566 4/1976 Hopkins ..... 62/475

5,065,594 11/1991 Yo ..... 62/195

*Primary Examiner*—Henry Bennett

*Assistant Examiner*—Melvin Jones

*Attorney, Agent, or Firm*—Wall Marjama Billinski & Burr

[57] ABSTRACT

Apparatus for purging non-condensable gases from an absorption system containing a purge tank connected to the system absorber for collecting non-condensables. A vacuum pump is connected to the tank for drawing the non-condensable gases from the tank and exhausting them to ambient. A solenoid actuated valve is mounted in the vacuum pumps discharge line which is arranged to close immediately when the pump is rendered inoperative during a normal shutdown or during a power failure.

4 Claims, 2 Drawing Sheets

PURGE SYSTEM FOR AN ABSORPTION AIR CONDITIONER

BACKGROUND OF THE INVENTION

This invention relates to an absorption refrigeration system and, in particular, to an improved apparatus for purging an absorption refrigeration system of non-condensable gases.

Non-condensable gases such as air, hydrogen, nitrogen and the like can find their way into absorption refrigeration systems during normal processing of the working substances or through leaks in the various system components. These non-condensables, if allowed to build up in the system, act to increase the pressure within the machine thereby reducing the machine's capacity. The non-condensables accumulate in the low pressure region of the system which is the absorber. It is the general practice to draw the non-condensables from the absorber and collect them in a purge storage tank which is periodically evacuated to ambient. The recommended means for evacuating the tank are to attach a vacuum pump to the tank and pump the non-condensables from the low pressure tank directly to the surrounding ambient.

One major problem with the use of a vacuum pump in association with a low pressure purge storage tank is the danger of oil from the pump backing up into the tank and then into the system. Even a slight amount of oil entering the system can have a harmful effect on the machine operation and performance. One prevalent way in which oil from the vacuum pump can quickly find its way into the system through the purge tank is during a power failure, occurring when the purge valve is open. Typically, at this time the purge tank is at a pressure of about 1/100 atmospheres and the pump discharge is at atmospheric pressure. This large pressure difference serves to push the oil in the pump rapidly back into the tank and then further into the absorption system.

Normally, the non-condensables along with water vapor and absorbent which, for purposes of this disclosure, is lithium bromide are present in the purge tank. Activating the purge vacuum pump brings the water vapor and a small quantity of LiBr in contact with the pump oil. When the pump is shut down, air is permitted to enter the pump through the pump discharge. The mixture of lithium bromide, water vapor and air has been found to be highly corrosive and can lead to early pump failure.

SUMMARY OF THE INVENTION

It is therefore an object of the present invention to improve absorption refrigeration systems.

A further object of the present invention is to improve purging apparatus used in absorption refrigeration systems.

A still further object of the present invention is to prevent oil from a vacuum purge pump from entering an absorption refrigeration system through the purging apparatus.

Another object of the present invention is to extend the life of vacuum pumps used to purge absorption refrigeration systems.

These and other objects of the present invention are attained by apparatus for purging non-condensables from an absorption refrigeration machine. The apparatus includes a purge tank that is connected to the system absorber for isolating and collecting non-condensable gases from the system. A vacuum pump is connected to the tank and arranged to exhaust non-condensables drawn from the tank to ambient. A solenoid actuated valve is connected into the pump discharge line and is arranged to immediately close the line in the event the pump is either shut down or experiences a power failure. This prevents pump oil from being pushed back into the system during a shut down and further prevents exposure of the pump to air that could accelerate corrosion of pump.

BRIEF DESCRIPTION OF THE DRAWINGS

For a better understanding of these and other objects of the present invention, reference will be made to the following detailed description of the invention which is to be read in conjunction with the associated drawings, wherein.

DETAILED DESCRIPTION OF THE INVENTION

Figure 1:
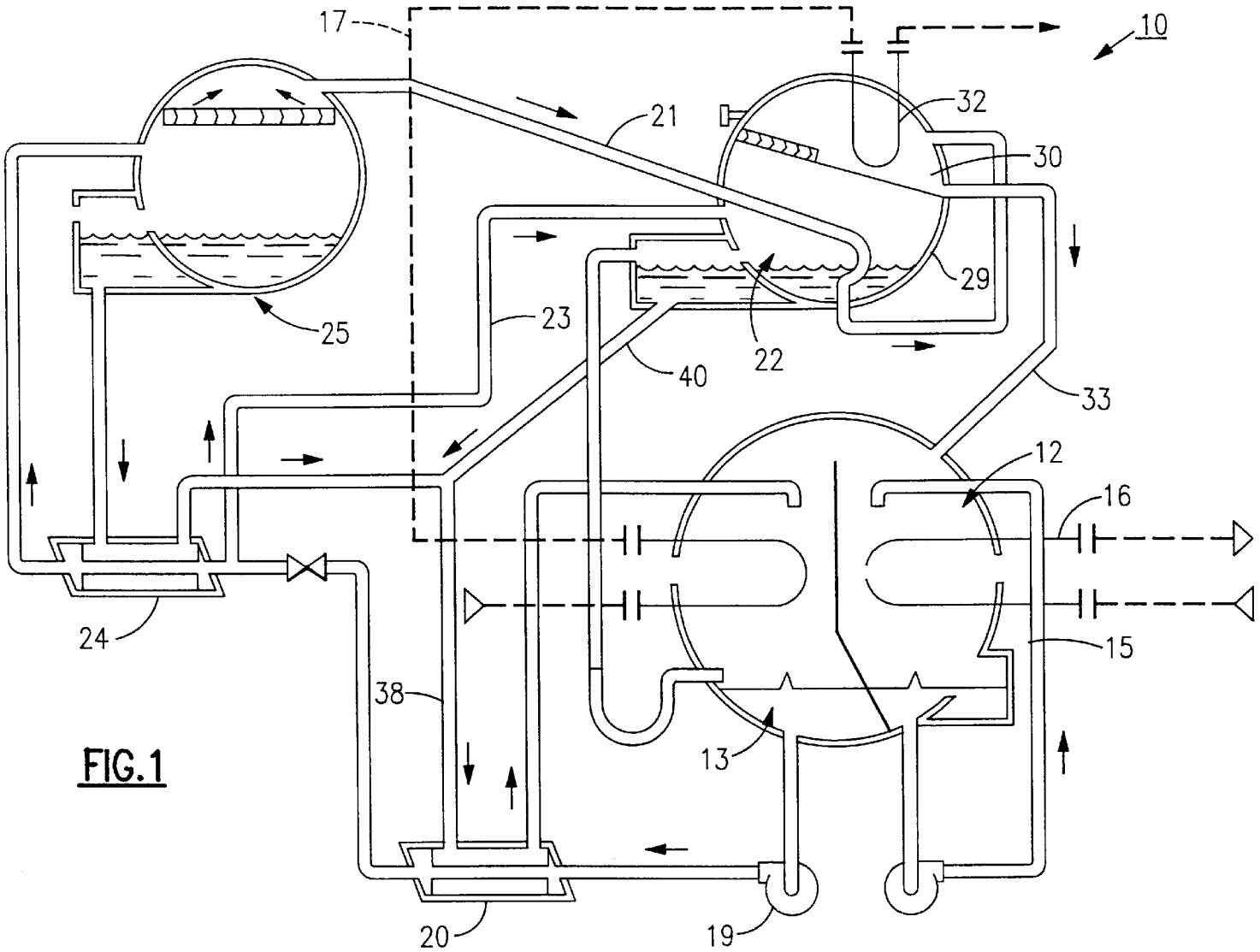
FIG. 1 is a schematic diagram of an absorption refrigeration system embodying the teachings of the present invention.

Referring initially to FIG. 1, there is illustrated in a schematic diagram illustrating a direct fired absorption refrigeration system, generally referenced 10, that embodies the teachings of the present invention. The absorption system of the type illustrated is a 16 series machine which is manufactured by Carrier Corporation in Syracuse, N.Y. Although the invention will be described with specific reference to a 16 series direct fired system, the invention has broader application and can be employed in association with any type of absorption chiller that must be purged or evacuated to remove excessive non-condensable gases which, if allowed to build up in the system, will act to reduce the chiller's efficiency.

The present system employs water as a refrigerant and lithium bromide (LiBr) as an absorbent. Lithium bromide has a high affinity for water and will absorb water in large quantities under the machine's normal operating conditions.

The chiller includes an evaporator section 12 and an absorber section 13 that are contained together within a single shell 15. Refrigerant water used in the process is vaporized in the evaporator as it absorbs heat from the substance being chilled which is carried through the evaporator by line 16. Vaporized refrigerant from the evaporator section is passed into the absorber section where it is absorbed by lithium bromide. Cooling water is passed through the absorber by a cooling water line 17 which carries away heat energy generated during the absorption process.

The weak solution which is rich in refrigerant is drawn from the absorber by a solution pump 19 and is passed through a low temperature solution heat exchanger 20. As will become evident from the disclosure below, the weak solution is brought into a heat transfer relationship with higher temperature strong solution which has given up much of its refrigerant in the process to increase the temperature and concentration of the weak solution.

Upon leaving the low temperature heat exchanger, about half of the weak solution is sent to the low temperature generator 22 via solution line 23. The remaining solution is sent through a high temperature heat exchanger 24 and passed into a high temperature generator 25. Although not shown, the solution in the high temperature generator is heated by a burner to vaporize the refrigerant. The water vapor is boiled away from the absorbent and is passed via vapor line 27 onto the low temperature generator section 22 which is housed in a separate shell 29 along with the system condenser 30. Here, the remainder of the weak solution is heated by the high temperature refrigerant to boil away further refrigerant.

The refrigerant vapor that is boiled away in the low temperature generator is passed into the condenser section 30 of the shell and is condensed on tubes 32 that carry cooling water through this section. The cooling water in this case is provided by the cooling water leaving the absorber which is delivered into the condenser by cooling water line 17.

The condensed refrigerant is flowed back to the evaporator by refrigerant line 33 to complete the cycle. In transit, the refrigerant is throttled or expanded from the high pressure side of the system to the low pressure side of the system.

The strong absorbent solution flows from the two generators back to the absorber to begin a new solution cycle. On the way back to the absorber the strong solution from the high temperature generator is passed through the first and second solution heat exchangers by return line 38 to give up its energy to the weak solution moving into the generators. Strong solution leaving the low temperature generator is connected into the return line 38 by feeder line 40.

Figure 2:
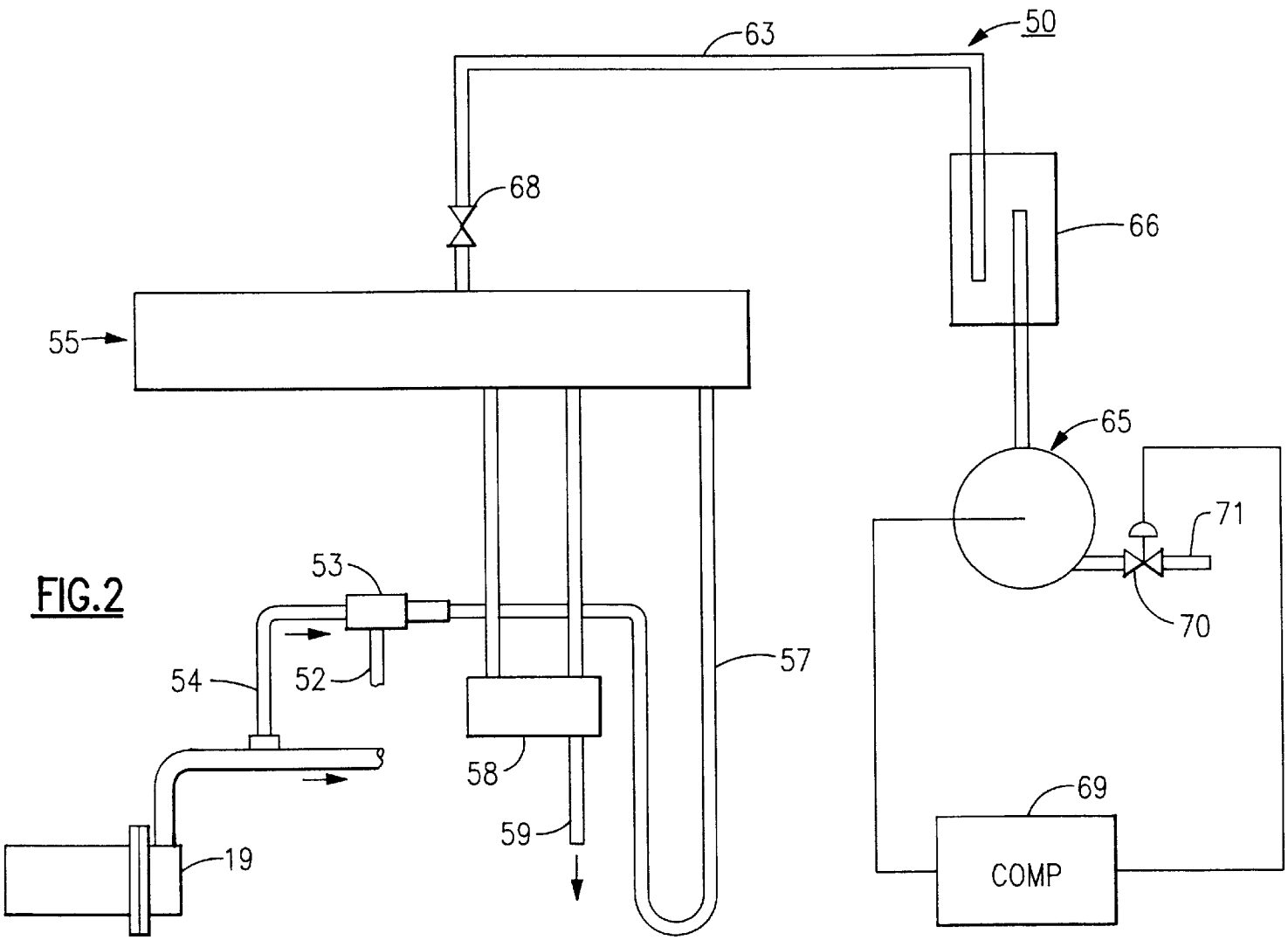
FIG. 2 is a side elevation showing a purge network for the absorption refrigeration system illustrated in FIG. 1.

Turning now to FIG. 2, there is shown a purge system, generally referenced 50 that serves to remove non-condensable gases from the chiller so that they cannot adversely effect the chiller's operation. These non-condensables include mostly hydrogen and air that will not condense at normal operating conditions and thus increase the pressure in the system which correspondingly reduces the machine's capacity. Hydrogen gas is liberated during normal operation of the process. Air can enter the system, on the other hand, during periodic maintenance or through leaks in various system components. The non-condensables collect in the absorber which operates at the lowest pressure within the system.

The non-condensables are drawn from the absorber by a purge line 52 into an eductor 53. In the eductor, the non-condensables are entrained in solution flowing from the solution pump 19 via line 54. The mixture is delivered into a purge storage tank 55 by a mixture line 57. Additional non-condensables are released in a separator 58 and the solution is returned to the generator overflow pipe (not shown) by line 59.

The non-condensables that are collected are removed from the tank through an evacuation line 63 under the influence of a vacuum pump 65. An oil trap 66 is connected into the evacuation line 63 between the vacuum pump and the purge valve 68. A discharge valve 70 is mounted in the pump discharge line 71 through which the non-condensable gases drawn from the storage tank are passed to atmosphere.

As is well known, the vacuum pump is flooded with oil. Any pump oil that might find its way back into the chiller through the purge system could cause serious damage to the chiller. When the purge system is operating normally and the vacuum pump is passing non-condensables to atmosphere, there is no danger of oil passing back into the system. However, in the event of a power failure, the pump is rendered inoperative and the purge tank and the oil trap are exposed to atmospheric pressure through the pump discharge. Because of the pressure difference between atmospheric pressure at the pump discharge and the chiller operating pressure, which is typically around 1/100 atmospheres, the oil in the pump can be quickly forced back through the purge system into the chiller before any preventative action can be taken. The oil trap will normally stop the oil from getting into the system, but is not always completely successful. The valve 70 is arranged to open the line any time power is applied to the valve and the vacuum pump is on. The discharge valve 70 is a remotely controlled solenoid actuated valve that is arranged to immediately close the discharge line 71 once power to the valve is terminated or the vacuum pump is off providing additional insurance against oil contamination in the system.

The present purge system also provides a further advantage in that it prevents air from entering the vacuum pump through the discharge line. During normal operation of the system, some lithium bromide is drawn out of the chiller along with the non-condensables. This lithium bromide eventually mixes with the oil in the vacuum pump. The combining of air with lithium bromide and oil in the pump can produce a harmful reaction in the pump leading to the corrosion of pump parts and thus early failure of the pump.

Both the solenoid actuated discharge valve in the vacuum pump discharge line and the pump motor are connected into the control unit 69 of the refrigeration machine. The control unit is programmed to close the discharge valve any time the pump motor is not in operation or in the event of a power failure. In either case, the discharge valve acts to prevent pump oil from being drawn into the machine during a power failure and air from entering the pump through the discharge line any time the pump is not operating.

While this invention has been explained with reference to the structure disclosed herein, it is not confined to the details set forth and this invention is intended to cover any modifications and changes as may come within the scope of the following claims:

What is claimed is:

1. Apparatus for purging non-condensable gases from an absorption refrigeration system that includes a purge tank connected to an absorber of an absorption refrigeration system for collecting non-condensable gases from the system;

a vacuum pump having an inlet connected to the purge tank by means of an inlet line and an outlet exhausted to ambient by means of a discharge line;

a solenoid actuated valve mounted in said discharge line that is arranged to open when the vacuum pump is operating and to immediately close when the vacuum pump is not operating or the vacuum pump experiences a loss of power.

2. The apparatus of claim 1 that further includes an oil trap mounted in said inlet line of said vacuum pump to prevent oil from said pump from moving back into said purge tank and said system when the pump is not in operation.

3. The apparatus of claim 2 that further includes a purge control valve mounted in said inlet line between the oil trap and the purge tank for selectively opening and closing the inlet line.

4. The apparatus of claim 1 that further includes a control means connected to the solenoid valve and the vacuum pump for closing the valve when the pump is rendered inoperative by said control means.

* * * * *

UNITED STATES PATENT AND TRADEMARK OFFICE

CERTIFICATE OF CORRECTION

PATENT NO. : 6,055,821
DATED : May 2, 2000
INVENTOR(S) : Deog Yong Song et al.

It is certified that error appears in the above—identified patent and that said Letters Patent is hereby corrected as shown below:

Column 1, Line 32, After the word failure please delete ",".

Column 2, Line 24, After the word diagram please delete "Illustrating".

Signed and Sealed this

Thirteenth Day of March, 2001

*Attest:*

Nicholas P. Godici

NICHOLAS P. GODICI

*Attesting Officer*

*Acting Director of the United States Patent and Trademark Office*